United States Patent [19]

Penner

[11] 4,289,305

[45] Sep. 15, 1981

[54] WORK PIECE HOLDER FOR WOODWORKING MACHINE

[76] Inventor: Gary W. Penner, 700 Ranchitos del Sol, Aptos

[21] Appl. No.: 103,569

[22] Filed: Dec. 14, 1979

[51] Int. Cl.[3] ..... B25B 1/24

[52] U.S. Cl. ..... 269/43; 269/55; 269/303; 409/226; 409/903

[58] Field of Search ..... 269/303–306, 269/315–320, 290, 228, 43, 37, 55, 56, 58; 409/145, 225, 226, 903; 83/415, 437, 435.1

[56] References Cited

U.S. PATENT DOCUMENTS

| | | | |
|---|---|---|---|
| 2,752,960 | 7/1956 | Poeltl | 269/228 X |
| 2,895,515 | 7/1959 | Ende | 83/437 |
| 3,994,326 | 11/1976 | Sarten | 83/437 X |

*Primary Examiner*—Robert C. Watson

*Attorney, Agent, or Firm*—Gerald L. Moore

[57] ABSTRACT

For use with a spindle molder or similar milling machine, there is provided a holder in which a plurality of work pieces can be mounted for movement in unison of each into engagement with the cutting tool by actuation of the holder. Provision is also made for contact with a power feeder so that the work piece holder can be power-driven across the table.

7 Claims, 4 Drawing Figures

WORK PIECE HOLDER FOR WOODWORKING MACHINE

BACKGROUND OF THE INVENTION

In various woodworking tools it is necessary to move a work piece across a table top and into engagement with a power-driven cutting blade. Usually the work piece is guided by a miter gauge having a guide bar which fits into a groove in the table surface. A rip fence is also used frequently to position the end of the work piece so that the cut is made at the right place.

Automatic feeders can be mounted on such woodworking tools having power-driven wheels which engage the work piece as it nears the cutting tool for driving the work piece forward past the cutting tool at a predetermined constant speed. However, in production work, it is advantageous if a plurality of work pieces are fed past the cutting tool in consecutive order. For this purpose there have been provided clamp attachments such as the Number 43-186 Sliding Shaper Jig made by Rockwell International which can be adjusted for holding short and narrow work while being moved along the groove in the work table.

It is the purpose of the present invention to provide a work holder in which can be mounted a plurality of work pieces in side-by-side arrangement for movement in unison into engagement with a cutting tool. Preferably the work piece holder is engaged by a power-driven feeder for control of the feed rate of the work pieces.

SUMMARY OF THE INVENTION

A work piece holder for use with a woodworking machine such as a spindle molder. The machine includes a power-driven cutting tool positioned adjacent the table edge to cut work pieces progressed across the table, usually for making end cuts for joining the ends of two work pieces together. The work piece holder comprises a planar base having a land positioned on one surface for fitting into the groove on the woodworking machine to guide the holder past the cutting tool. On the side of the base opposite the land, there is positioned a ledge adjacent the trailing edge and a clamp adjacent the forward edge. Work pieces are positioned on the base in side-by-side relationship and pressed tightly against the ledge by the clamp such that by movement of the base across the table with the land in the groove, the work pieces are mounted into engagement with the cutting tool in consecutive sequence. There is also provided a holding member fitting over the work pieces and forming a track which is contacted by the automatic feeder wheels for controlled movement of the work piece holder past the cutting tool.

DESCRIPTION OF THE INVENTION

Figure 2:
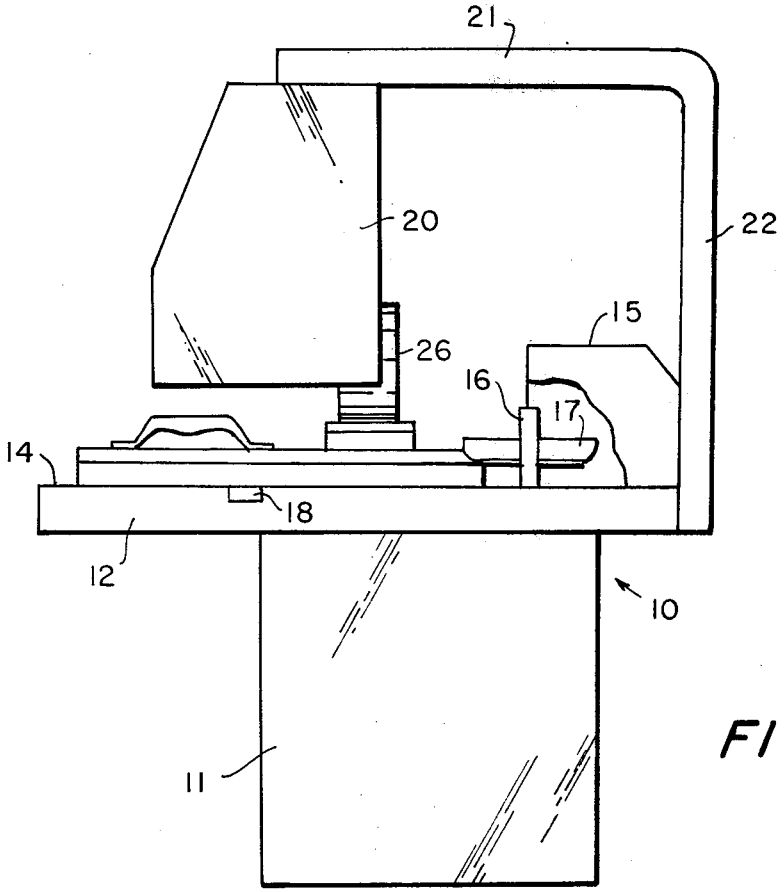
FIG. 2 is a typical woodworking machine on which the invention of FIG. 1 is mounted for movement of the work pieces past the cutting tool.
Figure 3:
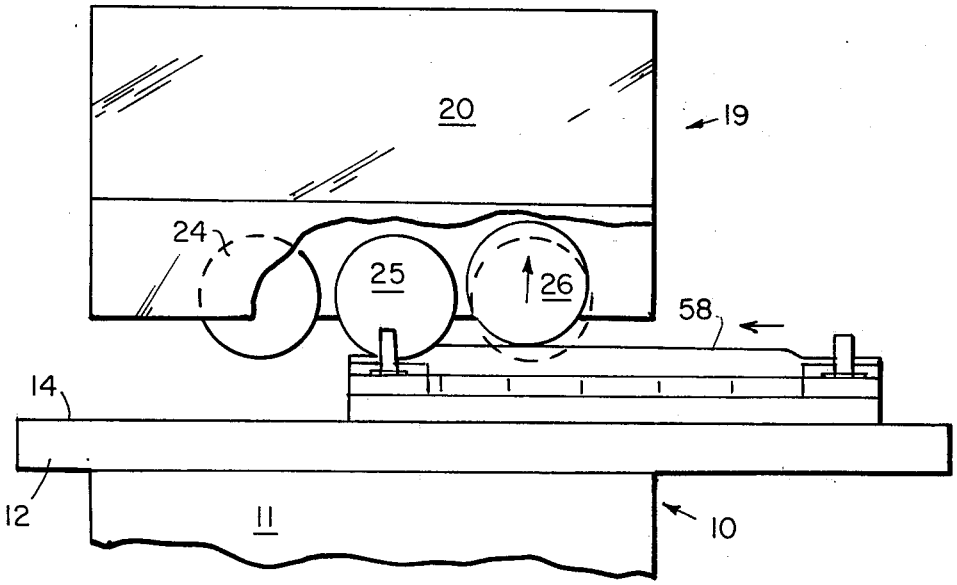
FIG. 3 is a side view of a portion of the woodworking machine showing the automatic feeder contacting the work piece holder.
Figure 4:
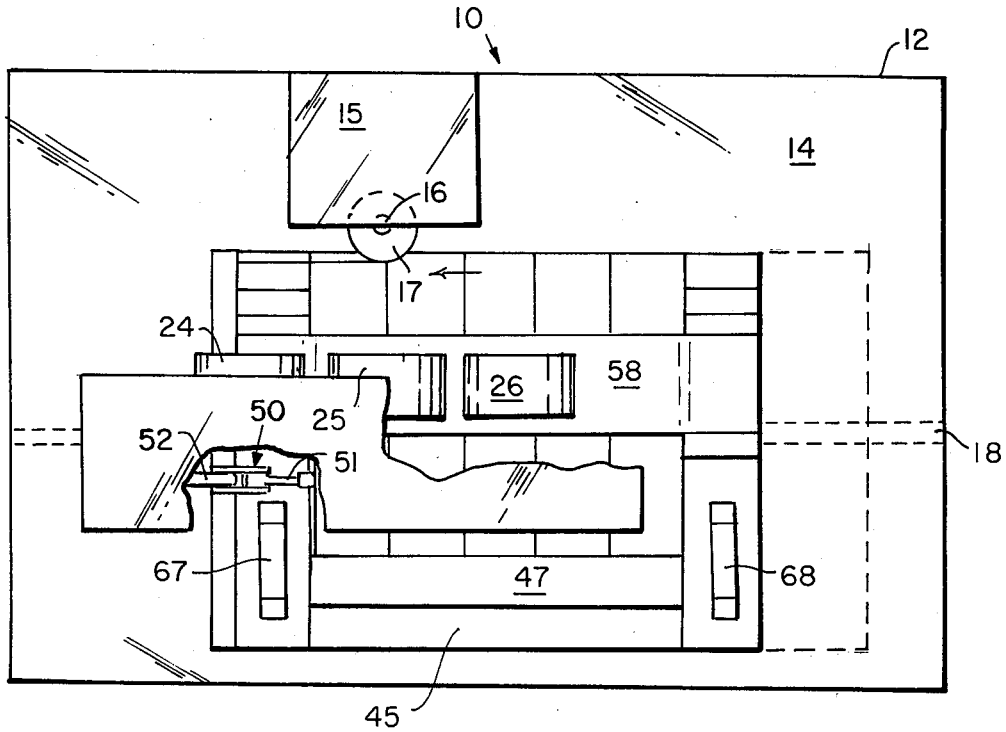
FIG. 4 is a top view of the woodworking machine with the work piece holder mounted thereon and a portion of the automatic feeder broken away to show the feeder wheels.

In FIGS. 2, 3 and 4 is shown a woodworking machine 10 of the type with which the subject invention is used. Represented in these drawings is a medium duty spindle molder made by the Wadkin Bursgreen Company, Type Ber.2. This machine includes a base 11 supporting a work table 12 having a horizontal planar surface 14. Positioned near one edge of the table is a guard 15 partially enclosing a spindle 16 on which is mounted a vertically extending cutter 17. The spindle 16 is power-driven by a motor (not shown) mounted in the base 11 so as to rotate the cutter 17 usually for shaping the long edge of the end of a work piece so that it can be joined with another work piece.

Most tables such as the table 12 include a guide groove 18 which normally receives the land of a miter gauge (not shown) for guiding a work piece past the cutter 17. For driving a work piece across the table there is included a power feeder 19 comprising a housing 20 fixed to a horizontal post 21 supported on a vertical post 22 fixed to the table. This power feeder includes three power-driven wheels 24, 25 and 26 each independently springloaded to contact and propel across the table a work piece to be cut. Usually the rotational speed of these wheels can be regulated for varying the velocity at which the work piece is pushed past the cutter. As shown in FIG. 3 the wheels move up and down so that they remain in close contact with the work piece as it proceeds across the table. If the table does not include a groove, generally other types of guides are provided along which a work piece can be moved.

Figure 1:
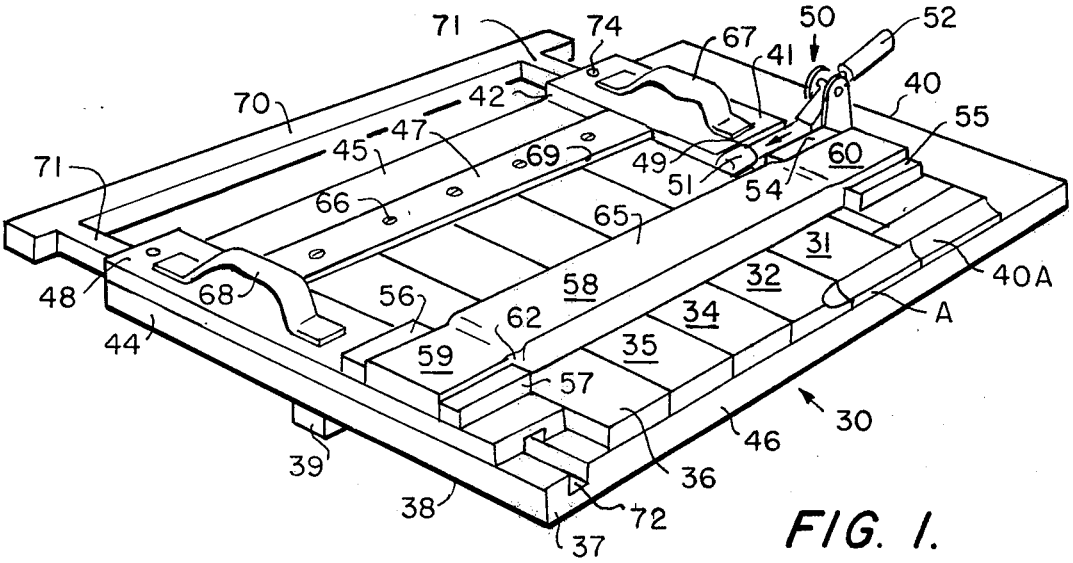
FIG. 1 is a perspective view of the work piece holder forming the subject invention with work pieces positioned thereon.

In accordance with the invention there is provided a work piece holder 30 as shown primarily in FIG. 1 on which can be mounted a plurality of work pieces 31, 32, 34, 35 and 36, primarily for the cutting of the forward edge of the work piece end A as the work piece is moved past the cutter 17. The holder comprises a base 37 having a planar undersurface 38 on which is fixed a land 39 to ride within the groove 18 of the woodworking machine and serve as means for guiding the holder. On the forward edge 40 of the holder 30, there is fixed a ledge 41 forming an edge 42 facing the trailing edge 44 of the base. The work pieces to be cut are mounted in side-by-side relation on the top surface 45 of the base 37 such that the edges A roughly align with or project past the edge 46 of the base. For lengthwise alignment of the work pieces, which usually are already precut to length, there is provided an adjustable fence or guide 47 which fits between the ledge 41 on the trailing edge of the holder and a similar ledge 48 positioned along the forward edge of the holder. The work piece ends can be butted against this guide for alignment. Also there is provided a chip board 40A which reinforces the work piece ends as the cutting tool is contacted. This chip board preferably is replaceable by the removal of screws (not shown).

The forward edge ledge 48 includes a cutout portion 49 to accommodate a clamp 50 comprising a plunger 51 and a lever handle 52. By actuation of the handle 52, the plunger 51 can be caused to move towards the leading edge of the work holder. In this manner the plunger is brought into contact with the forward edge of the closest work piece 31 to thereby clamp the work pieces together in side-by-side relationship with the trailing work piece being pressed against the edge 42 of the ledge 41. The work pieces are held firmly in position and in alignment with the edge 42 in this manner. The plunger 51 is threaded into the actuator 53 and can be rotated to adjust the range of stroke for accommodating work pieces of varying widths.

Positioned on the top surface of the ledges 41 and 48 are pairs of guides 54 and 55 and 56 and 57, respectively. These guide pairs are spaced apart for positioning a holding or clamping member 58 which extends the length of the holder and overlaps the forward and trailing edge ledges. While not shown it is preferable to fix to the bottom surface of this holding member a cushioning material to make sure material of varying thicknesses will be contacted to prevent movement or slippage while being cut. The end portions 59 and 60 are slighly narrower than the center portion 61 so as to form edges 62 and 64 which fit against the inward facing ends of the guides and prevent the member from moving lengthwise.

This holding member forms a top surface 65 positioned to align with the wheels 24, 25 and 26 of the power feeder 20 when the work piece holder moves along the groove 18. In the manner shown in FIGS. 3 and 4, the work piece holder is mounted on the top surface of the table with the land 39 fitting within the groove 18 and shifted manually until the first drive wheel 26 comes into contact with the forward edge of the clamping member 58. The forward edge preferably is tapered somewhat as shown in the drawings to allow the wheels to ride up on the top surface 65. In this manner the drive wheels are used to both propel the work piece holder forward to bring the forward edges A of the work pieces into contact with the cutter 17 and also to hold the work pieces flat against the top surface 45 of the base 37 so that an accurate and straight cut will be made even though the work pieces may be of slightly different thicknesses and in some instances, slightly warped.

The fence 47 is held in position by bolts or screws 66 threaded into the base 37 or in another suitable manner to allow adjustment of the fence position. The handles 67 and 68 are provided for lifting the work piece holder. When making end cuts on both ends of the work pieces to even up the board length, it has been found desirable to use a thin 1/32" spacer 69 between the fence 45 and the finished work piece ends so the fence does not have to be reset. Also for longer work pieces there is provided a substitute fence 70 held on two pins 71 which fit into channels 72 and are held in place by screws 74. For maximum benefit from the work piece holder, a plurality are used with one woodworking machine such that one or more can be loaded and unloaded while one is being fed through the machine for machining of the work pieces. Also chip boards 40A are mounted at the ends of the ledges.

The invention claimed:

1. A work piece holder for a woodworking machine wherein said machine has a power-driven cutting tool, a table adjacent the cutting tool over which the work pieces are progressed, a guide on said table for guiding the work pieces and a power feeder having power-driven wheels for contacting and feeding the work past the cutting tool, said work holder comprising:

a base on which a plurality of work pieces are placed;

a first ledge on one side of said base forming an edge against which the work pieces are aligned;

clamping means for exerting and edgewise pressure on said work pieces to hold them tightly in alignment with said ledge;

a holding member fitting over the work pieces and aligned with the power-driven wheels of the power feeder and including a top surface on which the wheels can ride; and means for guiding said work piece holder along said table guide to bring the work pieces into contact with said cutting tool.

2. A work piece holder as defined in claim 1 wherein said means for guiding said work holder comprises a land fixed to said base in position to ride along the guide of said table.

3. A work piece holder as defined in claim 1 wherein said ledge includes means for holding said holding member in place over the work pieces.

4. A work piece holder as defined in claim 1 including a second ledge fixed to said base in spaced parallel relationship to said first ledge.

5. A work piece holder as defined in claim 4 wherein said second ledge supports said clamping means.

6. A work piece holder as defined in claim 1 including a fence extending perpendicular to said first ledge for aligning said work pieces.

7. A work piece holder as defined in claim 5 including a fence extending perpendicular to said first ledge for aligning said work pieces.

* * * * *